US006464431B1

(12) United States Patent
McNulty

(10) Patent No.: US 6,464,431 B1
(45) Date of Patent: Oct. 15, 2002

(54) APPARATUS AND METHOD FOR RAISING BURIED HOUSINGS

(76) Inventor: Edward McNulty, 12432 Old Mill Rd., Midland, VA (US) 22728

( * ) Notice: Subject to any disclaimer, the term of this patent is extended or adjusted under 35 U.S.C. 154(b) by 0 days.

(21) Appl. No.: 09/908,556

(22) Filed: Jul. 20, 2001

Related U.S. Application Data

(60) Provisional application No. 60/294,214, filed on May 31, 2001.

(51) Int. Cl.[7] ..... A61G 19/00; E02D 35/00

(52) U.S. Cl. ..... 405/229; 405/303; 248/354.3

(58) Field of Search ..... 405/229, 303, 405/154.1; 248/354.1, 354.3, 188.4

(56) References Cited

U.S. PATENT DOCUMENTS

| | | | | | |
|---|---|---|---|---|---|
| 821,954 | A | | 5/1906 | McCormick | 254/280 |
| 862,775 | A | | 8/1907 | Warren | 254/100 |
| 1,101,217 | A | | 6/1914 | Stamm | 254/279 |
| 2,039,464 | A | * | 5/1936 | Troup | 254/324 |
| 2,263,871 | A | | 11/1941 | Duffy | 254/100 |
| 2,657,938 | A | * | 11/1953 | Browne et al. | 414/460 |
| 2,988,330 | A | | 6/1961 | Allison | 254/98 |
| 3,074,693 | A | | 1/1963 | Shumake | 254/92 |
| 4,398,761 | A | | 8/1983 | Hanson et al. | 294/104 |
| 4,491,452 | A | | 1/1985 | Matovich | 414/427 |
| 4,743,039 | A | | 5/1988 | Ellis | 280/42 |
| 4,774,386 | A | * | 9/1988 | Goodwin | 254/264 |
| 4,897,011 | A | * | 1/1990 | Brower | 254/2 R |
| 4,928,927 | A | | 5/1990 | Fredrick et al. | 254/279 |
| 4,962,913 | A | * | 10/1990 | Stewart | 254/269 |
| 5,674,045 | A | | 10/1997 | Eckloff et al. | 414/684.3 |
| 5,713,559 | A | | 2/1998 | McClarin et al. | 254/124 |
| 5,947,633 | A | | 9/1999 | Foss | 404/25 |
| 5,988,597 | A | * | 11/1999 | Egan | 254/279 |

* cited by examiner

*Primary Examiner*—Thomas B. Will
*Assistant Examiner*—Tara L. Mayo
(74) *Attorney, Agent, or Firm*—Diederiks & Whitelaw, PLC

(57) ABSTRACT

An apparatus for raising a buried housing or other article includes a frame, a plurality of support leg assemblies, a plurality of lifting members for attaching the frame to the buried housing, and a device for raising the frame, and thereby the buried housing, relative to a supporting ground surface. Preferably, the frame includes a pair of pivotally attached crossbar sections, the lifting members constitute chains, and the support leg assemblies include threaded rods and pivotable support feet. The apparatus is adapted to be supported above a buried article which is attached to the frame through the lifting members. Thereafter, the frame is lifted relative to the support leg assemblies to raise the article to enable back-filling beneath the article in order to maintain the article at a desired height upon disconnection of the apparatus.

16 Claims, 7 Drawing Sheets

APPARATUS AND METHOD FOR RAISING BURIED HOUSINGS

This application claims benefit of provisional application Ser. No. 60/294,214 filed on May 31, 2001.

BACKGROUND OF INVENTION

1. Field of Invention

The present invention pertains to an apparatus and method for lifting buried housings or other articles and, more specifically, to the field of lifting buried housings which surround either irrigation components or electrical equipment such as might be found on a golf course.

2. Discussion of Prior Art

For various reasons, it is often necessary to raise certain objects. Therefore, a variety of mechanisms have been designed for lifting objects ranging from vehicle engines to man-hole covers. Sometimes it is also necessary to raise buried objects, such as coffins. In any event, the devices used for these purposes are generally, specifically constructed for their particular use. In other words, the devices are dedicated for use in a particular field and are not readily re-configured to perform non-designated tasks.

There also exist other environments in which buried objects sometimes need to be raised. In particular, at golf courses, certain residences and commercial establishments, it is often common to find in-ground sprinkler and/or wiring systems. In some situations, it is necessary to access certain sections of these systems for repair or control purposes. For example, water control valves and junction boxes associated with sprinkler and wiring systems often need to be made available. Although arranging these system sections above ground level is sometimes a potential solution, often times, above ground mountings are not a viable option. In the case of golf courses, a sprinkler control valve or other system component may have to be located right in the middle of a fairway, directly adjacent a putting green or in another location which would make an above-ground mounting impermissible.

For this reason, it is not uncommon to bury a housing or box which surrounds the buried system component or section, with the housing having a cover which is substantially level with the surrounding ground surface. With this arrangement, the cover can be easily removed, while being generally unobtrusive when arranged atop the housing. Unfortunately, due to weather, natural settling and the like, buried irrigation or electrical housings will settle below the surface of the ground. When that occurs, particularly in the case of a golf course, it becomes desirable to raise the housing so that the cover is maintained with its upper surface even with the surrounding landscape.

When such a housing sinks, it is necessary to excavate the earth, raise the housing, support the housing at a desired level, back-fill the soil, and reseed the area. Obviously, this is a labor intensive process which requires several hours to accomplish, not to mention the time required for the grass to regenerate.

Based on the above, there exists a need in the art for an apparatus and method for use in connection with lifting buried housings which have settled or otherwise sunk below a desired ground level in a cost and time effective manner. In addition, there exists a need for an apparatus and method for lifting a buried housing without the need to excavate the area surrounding the housing.

SUMMARY OF THE INVENTION

The present invention is particularly directed to a method and apparatus for raising buried housings without the need to excavate the surrounding earth. This ability will reduce both labor costs and the time required for the landscape to replenish itself.

The buried housing raiser arrangement of this invention includes a frame, a plurality of support legs, a plurality of lifting members for attaching the frame to the buried housing, and a device for raising the frame, and thereby the buried housing, relative to a supporting ground surface. While it is understood that this invention contemplates the ability to raise and lower a variety of buried articles, and by buried it is meant both fully and partially buried articles, the invention has particular applicability in connection with raising buried housing used to surround buried irrigation or electrical components, such as those typically found on a golf course.

In accordance with the invention, when it becomes necessary to raise a buried housing, the apparatus of the invention is placed above the housing, and the lifting members are positioned on the frame so as to be located above the housing. The lifting members are then attached to the housing, thereby interconnecting the frame and the buried housing. Thereafter, the entire frame is raised relative to the ground in order to draw the housing from the ground to a desired height. Once the housing is raised, the void below the housing is back-filled, the housing is disconnected from the frame and the apparatus is removed. Finally, the housing and the surrounding ground area can be tamped into place. In this manner the buried housing can be efficiently re-positioned with minimal effort and disturbance of the surrounding landscape.

Additional objects, features and advantages of the invention will become more readily apparent from the following detailed description of a preferred embodiment thereof when taken in conjunction with the drawings wherein like reference numerals refer to corresponding parts in the several views.

DETAILED DESCRIPTION OF THE INVENTION

Figure 1:
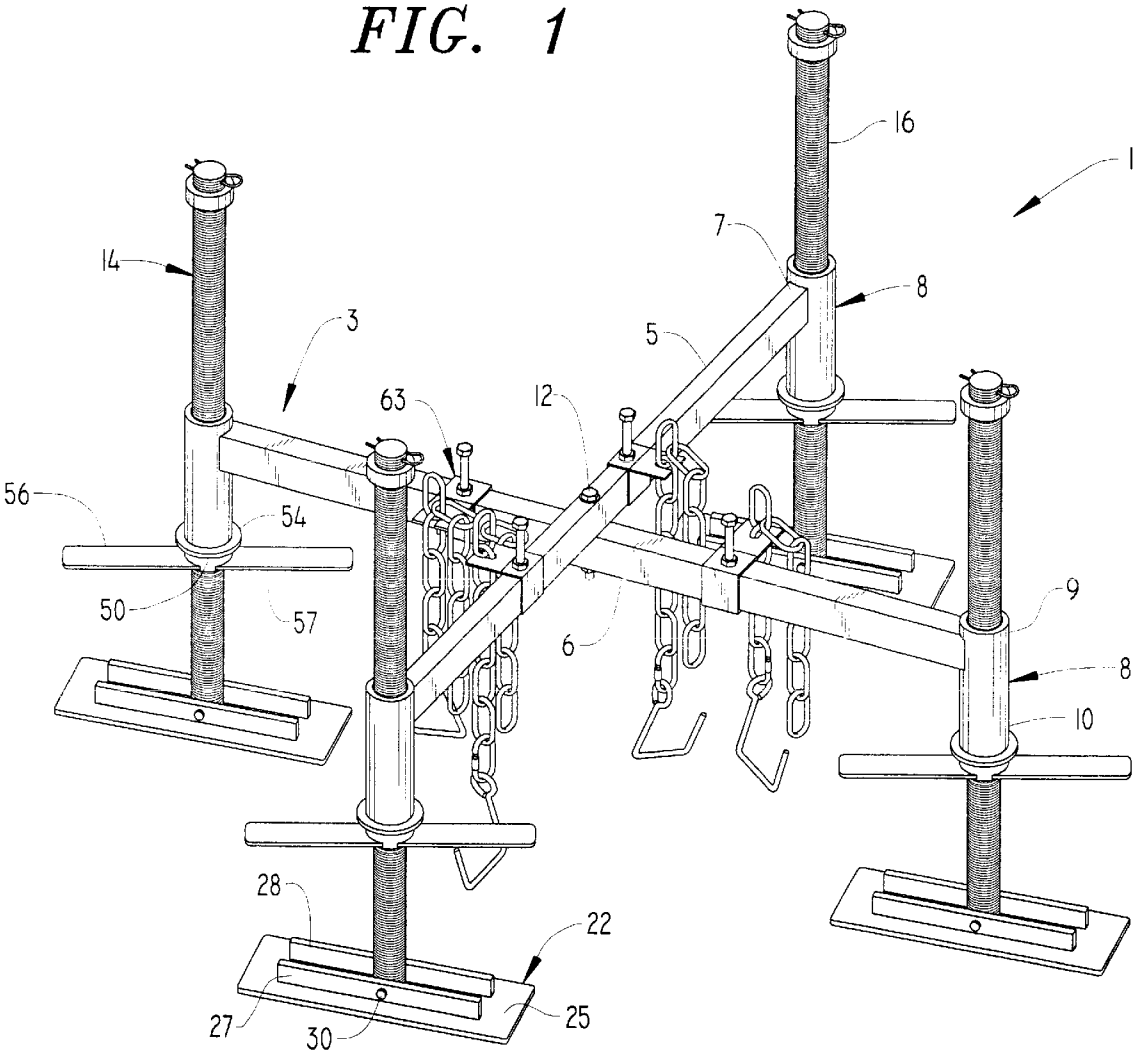
FIG. 1 is a perspective view of a preferred embodiment of the housing raising apparatus of the present invention.

With initial reference to FIG. 1, the housing lifter apparatus of the invention is generally indicated at 1. As shown, apparatus 1 includes a frame 3 defined by an upper crossbar section 5 and a lower crossbar section 6. At the terminal end 7 of each of the upper and lower crossbar sections 5, 6 is mounted a guide tube 8. More specifically, each guide tube 8 includes an upper end 9, which is welded or otherwise fixedly secured to a respective terminal end 7, and a lower end 10. As shown, upper crossbar section 5 and lower crossbar section 6 are pivotally joined proximate their midpoints by a fastener 12. In this manner, upper and lower crossbar sections 5 and 6 can pivot relative to one another about an upright rotational axis defined by fastener 12. The purpose of this pivoting motion is really two fold, i.e., to enable angular adjustments between upper and lower crossbar sections 5 and 6 depending on the particular terrain at the job to be performed and to enable the frame 3 to be arranged in a more compact configuration for transport and storage purposes. As also shown in this figure, frame 3 includes a plurality of support leg assemblies generally indicated at 14.

Figure 2:
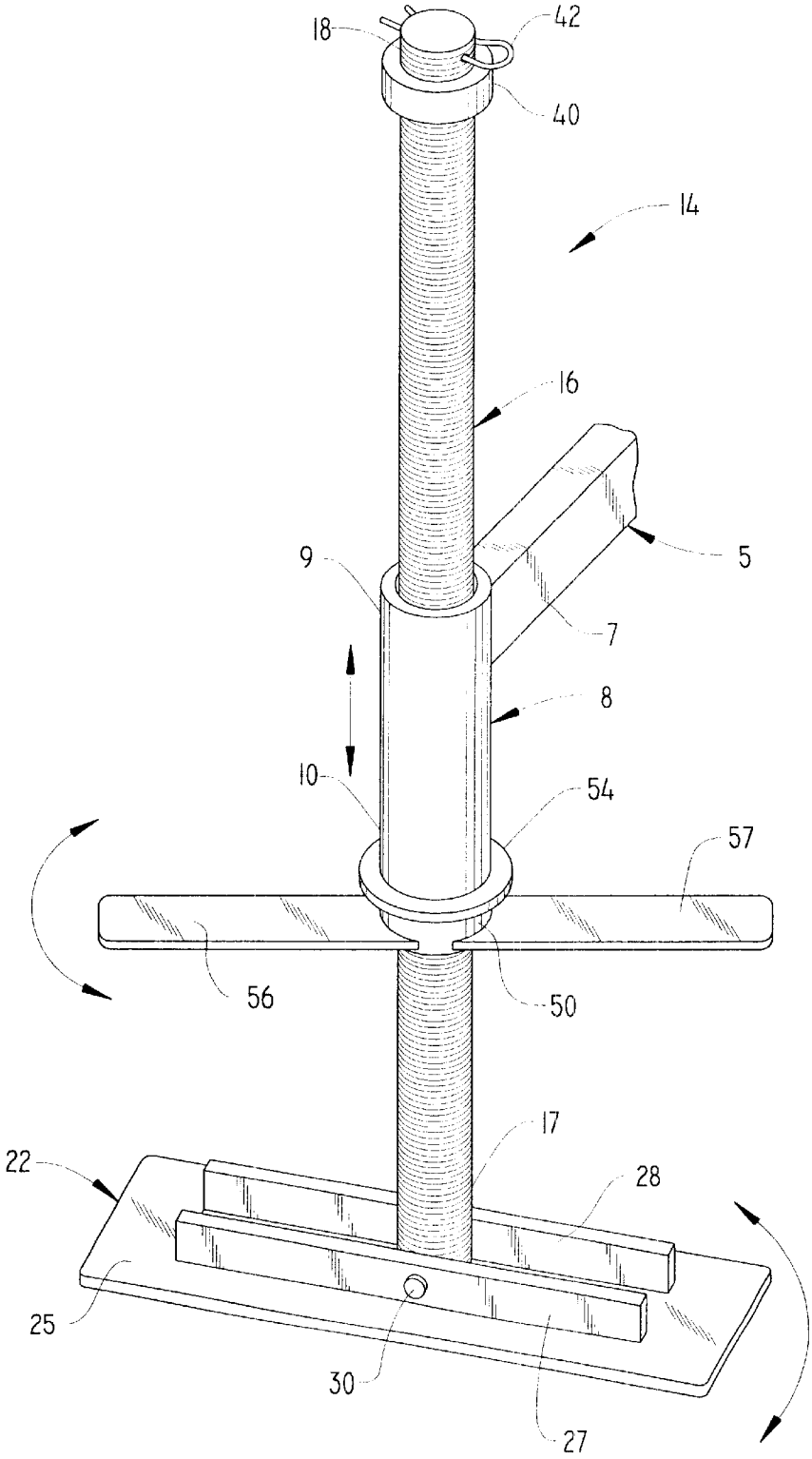
FIG. 2 is an enlarged perspective view of a support member incorporated in the apparatus of FIG. 1.

Referring to FIG. 2, each support leg assembly 14 includes a threaded rod 16 having a first end 17 and a second end 18. First end 17 hingedly supports a foot plate 22. More particularly, each foot plate 22 is defined by a base plate 25 and a pair of space, substantially parallel extending mounting rails 27 and 28. Foot plate 22 is pivotally attached to first end 17 by a fastener unit 30 extending through rail 27, first end 17 of rod 16 and rail 28. Although a nut and bolt combination is preferably utilized for this connection, any known type of fastening arrangement which accommodates pivoting of foot plate 22 relative to rod 16 could be utilized. As will be discussed more fully below, foot plates 22 are adapted to rest upon a ground surface to support frame 3 above a buried housing to be raised. The second end 18 of each rod 16 has positioned thereon an end stop 40 in the form of an elastomeric ring. End stop 40 defines a cushioned upper extension limit for frame 3 along rods 16 and is retained from coming off second end 18 by means of a pin 42 extending through second end 18 above end stop 40.

As clearly shown in each of FIGS. 1 and 2, each rod 16 is preferably threaded along its entire length from first end 17 to second end 18. Positioned below each guide tube 8 is a lifting collar 50. Lifting collar 50 is threadably engaged with rod 16 such that rotation of lifting collar 50 in either a clockwise or counterclockwise direction, will serve to raise or lower frame 3 relative to a respective support leg assembly 14. In the most preferred embodiment, lifting collar 50 is rotatably supported by a flange ring 54 which is fixed to the lower end 10 of guide tube 8. A pair of arms 56, 57 extend in opposite directions from lifting collar 50 and act as handles which can be grasped by a user to rotate collar 50, thereby adjusting the desired height of frame 3 relative to support leg assembly 14.

Figure 3:
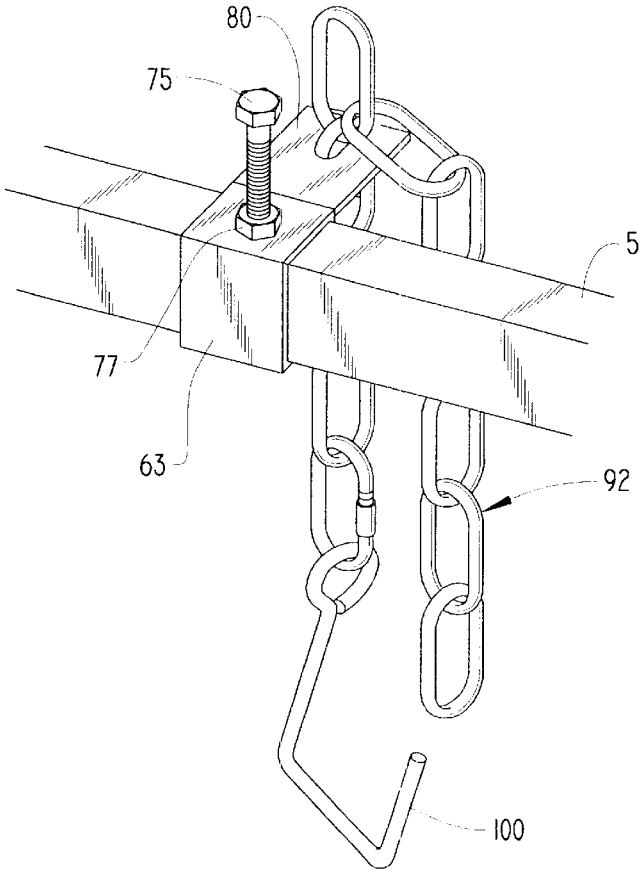
FIG. 3 is a perspective view of a lifting arrangement incorporated in the apparatus of FIG. 1.
Figure 4:
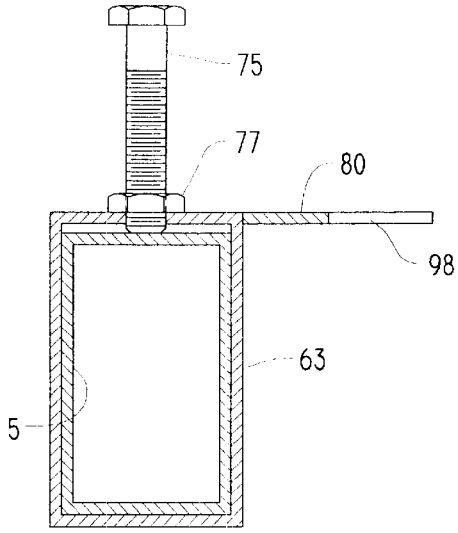
FIG. 4 is a cross-sectional view of a portion of the lifting arrangement of FIG. 3.

Referring now to FIGS. 1, 3 and 4, mounted on each of upper and lower crossbar sections 5 and 6 of frame 3 are spaced, adjustable brackets 63. In the most preferred form of the invention, upper and lower crossbar sections 5 and 6 have generally rectangular cross-sections. Brackets 63 have a corresponding, but slightly enlarged cross-section such that brackets 63 are adapted to slide along crossbar sections 5 and 6 between fastener 12 and a respective guide tube 8. Adjustable brackets 63 may be locked in a desired position along a respective crossbar section 5, 6 by the tightening of a locking bolt 75, which is threaded through a locking nut 77 that is welded or otherwise fixed to bracket 63, against crossbar section 5, 6. Projecting from adjustable bracket 63 is a flange 80 which is adapted to receive one end of a lifting element 92. Lifting element 92 is shown in the form of a chain having a plurality of links 95. However, it is contemplated that a variety of elements may be used for this purpose such as, for example, a rope, metal cable or lifting strap. In the preferred embodiment shown, flange 80 is formed with an open ended slot 98 for supporting the lifting element 92 in a desired, adjustable position as will be further detailed below. Provided at an end of lifting element 92 is a lifting member 100 which takes the form of a hook. As will become more fully evident below, lifting member 100 can take a variety of forms, particularly depending on the specific structure of the buried article to be raised.

Figure 5:
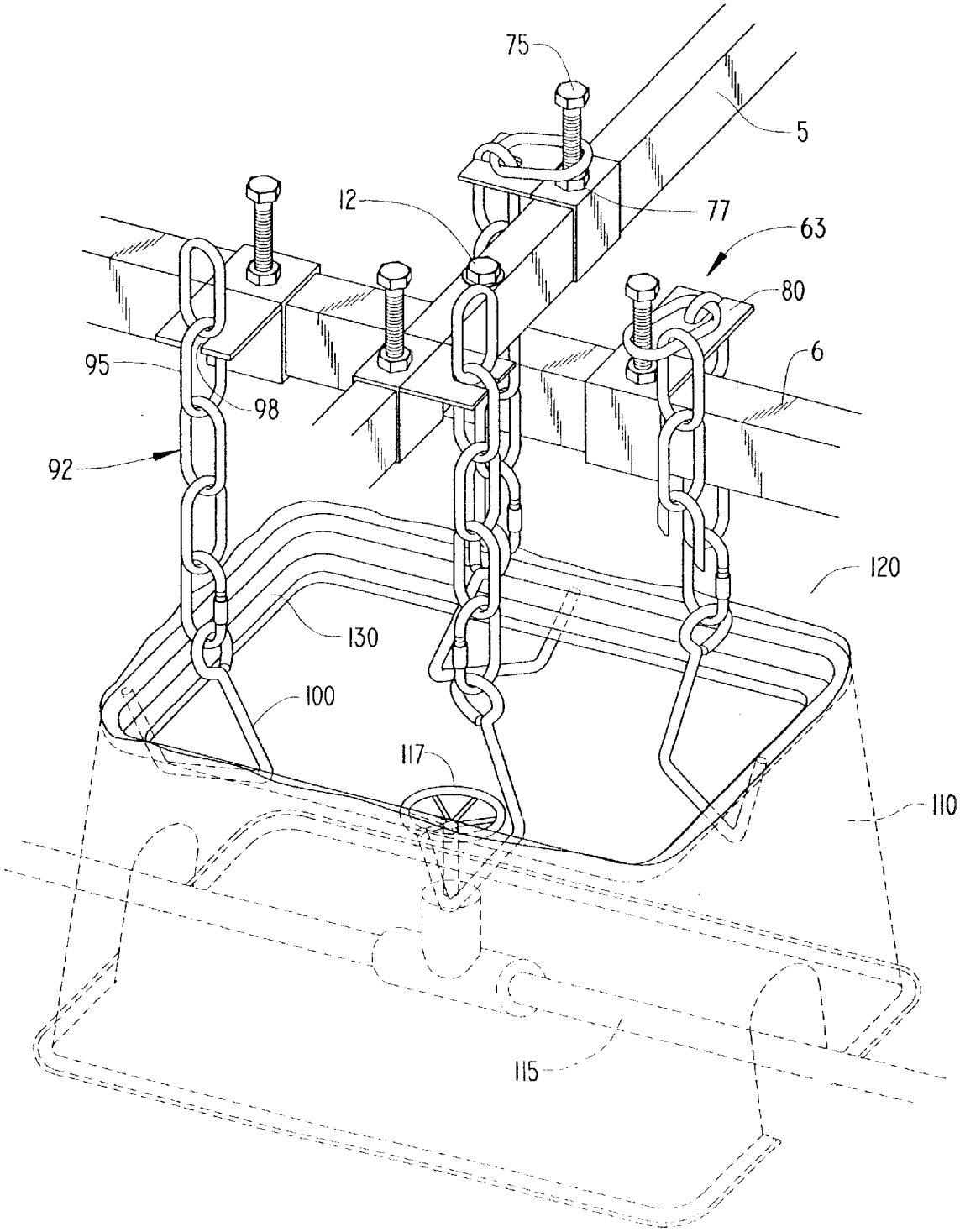
FIG. 5 is a partial perspective view of the apparatus of FIG. 1 in an initial lifting position.
Figure 6:
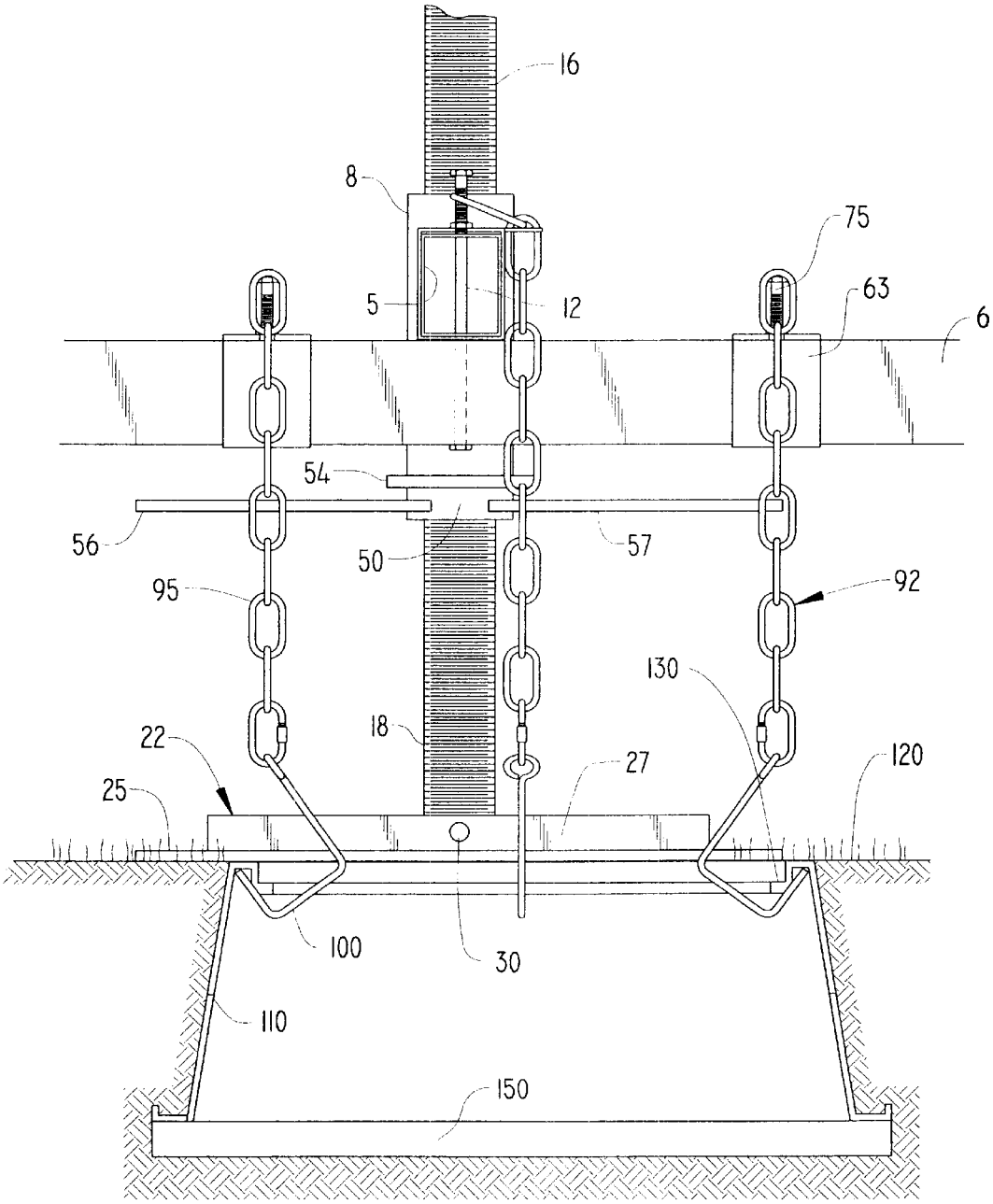
FIG. 6 is an elevational side view of a portion of the apparatus in a subsequent lifting position.
Figure 7:
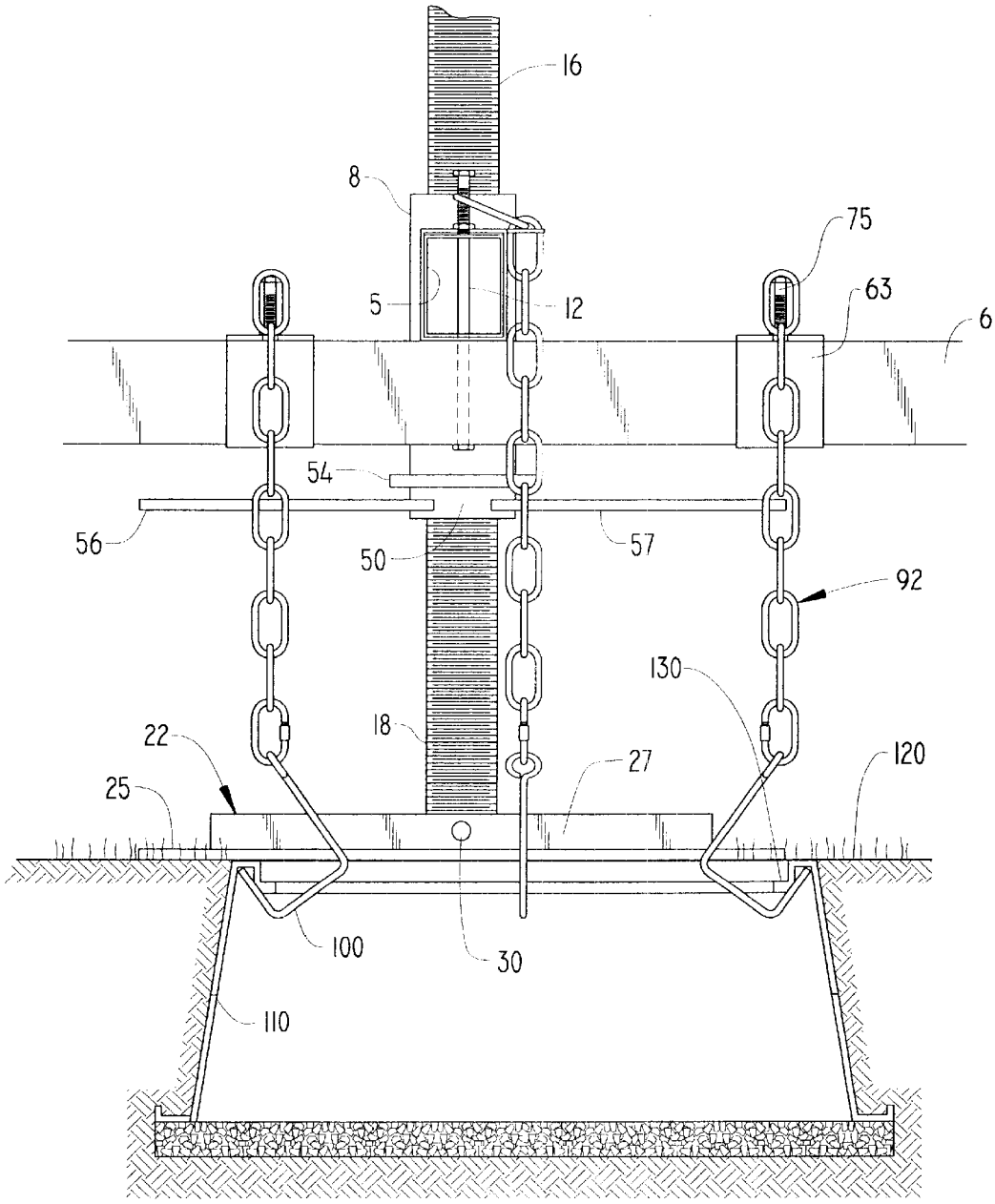
FIG. 7 is an elevational side view of a portion of the apparatus in a final lifting stage.

For a more complete understanding of the invention, the method of using apparatus 1 will be described in accordance with a preferred application, i.e., the raising of buried housings which surround subterranean irrigation or electrical devices. Referring to FIGS. 5–7, lifting apparatus 1 is partially shown positioned above a buried housing 110. Buried housing 110 is shown to cover a portion of an irrigation pipe 115 having an associated valve 117. However, it is contemplated that housing 110 could be used to protect not only irrigation pipe 115, but other elements used for irrigation, electrical devices or any other objects located below the surface of the ground which require access.

At this point, it should be realized that there is a desired height for housing 110 relative to a ground surface 120. In the scenario presented, for whatever reason, e.g. settling, housing 110 has shifted to the recessed position of FIG. 5 and it is desired to raise housing 110 to a fully supported position which is substantially flush with ground surface 120. As indicated above, this invention has particular applicability in raising buried irrigation or electrical housings 110 provided on a golf course wherein maintaining a proper height for housing 110, which would have an associated cover (not shown), is considered extremely important. In any event, in order to raise buried housing 110, apparatus 1 is placed above housing 110 with the intersecting axes of upper and lower crossbar sections 5 and 6 being generally positioned above the midpoint of housing 110.

At this point, frame 3 is in a generally lowered position that is parallel to or tracts the contour of the ground surface 120 through the adjustment of the individual leg leveling assemblies 14. Next, each lifting member 100 is engaged with housing 110. In the preferred embodiment shown, housing 110 has an annular, upper lip 130 which is undercut such that lifting members 100 can engage housing 110 behind lip 130. With brackets 63 positioned along crossbar sections 5 and 6 basically corresponding to the dimensions of housing 110, locking bolts 75 are tightened to fix brackets 63 in place. Thereafter, lifting elements 92 are straightened and a respective link 95 is placed within each slot 98. FIG. 5 illustrates that a link 95 can further be looped over a respective locking bolt 75 as well. By the sequential rotation of collars 50 through arms 56 and 57, frame 3 is shifted vertically relative to foot plates 22. Concurrent with the lifting of frame 3 is the raising of housing 110. Once housing 110 reaches a desired level as represented in FIG. 6, a void 150 created beneath housing 10 can be back-filled as shown in FIG. 7. Then, frame 3 can be lowered through arms 56 and 57 until lifting members 100 can be disengaged from housing 110. At this point, apparatus 1 can be removed and, aside from possibly patting down the ground surface 120 about housing 110, the job is complete. Therefore, with apparatus 1, the task of raising housing 110 is greatly simplified. In general, this overall process takes a small fraction of the time needed to raise housing 110 versus excavating the area surrounding housing 110 as done in the past.

Figure 8:
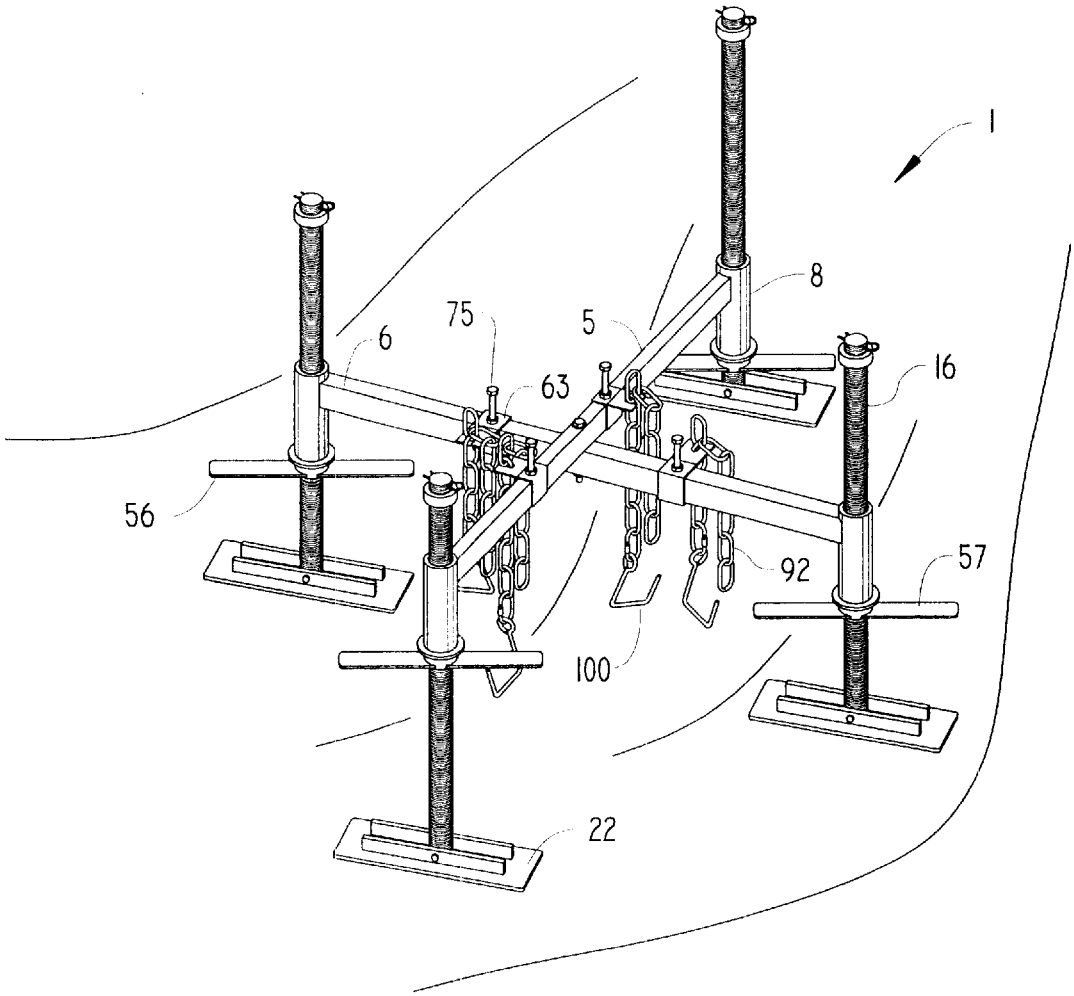
FIG. 8 is a perspective view of the apparatus of FIG. 1 illustrating the positioning of the apparatus on un-even terrain.

The lifting apparatus 1 of the present invention can be adapted to lift objects from a wide range of surfaces. FIG. 8 depicts lifting apparatus 1 on an inclined surface 160 showing the adaptability of apparatus 1 as it is supported on leg assemblies 14. As illustrated by this figure, frame 3 can be supported at various angles. That is, since the terrain in which housing 110 is buried can range from horizontal to some angle with respect to the horizontal, and it is desired to lift housing 110 to a position flush with this terrain, frame 3 may itself have to assume a non-level position or a level position on a non-level terrain. In any event, this can be readily accommodated by the individual adjustments that can be made through each support leg assembly 14. Obviously, this potential adjustment arrangement enhances the versatility of apparatus 1.

Although described with reference to a preferred embodiment of the invention, it should be readily understood that various changes and/or modifications can be made to the invention without departing from the spirit thereof. For instance, the particular configuration or attachment of lifting members 100 to housing 110 can greatly vary depending on the desired construction of these components. In addition, it should be noted that the overall apparatus 1 can be used to suspend housing 110 during initial installation. In any event, as should be readily apparent, apparatus 1 defines a versatile device which can be used to perform needed functions on a wide range of varying sized and shaped housings in an economical and efficient manner. In any event, the invention is only intended to be limited by the scope of the following claims.

I claim:

1. An apparatus for raising a buried article comprising:

a plurality of support leg assemblies, each of said support leg assemblies having a first end adapted to be placed upon a supporting surface, and a second end;

a frame shiftably mounted on said support leg assemblies wherein the frame can be lifted and lowered relative to the supporting surface, said frame including upper and lower crossbar sections having terminal ends, with the upper and lower crossbar sections being pivotally interconnected; and a plurality of lifting elements, each of said lifting elements having a first portion adapted to be connected, at a selected position along a length of a respective said lifting element, to said frame, and a second portion adapted to be removably attached to a buried article, wherein a buried article interconnected to the frame through the plurality of lifting elements can be raised upon shifting of the frame relative to the plurality of support leg assemblies.

2. The apparatus according to claim 1, wherein said frame further includes a plurality of guide tubes, each of said plurality of guide tubes being attached to a respective one of the terminal ends of said upper and lower crossbar sections.

3. The apparatus according to claim 1, further comprising a plurality of brackets slidably mounted on the upper and lower crossbar sections, each of said lifting elements being attached to the frame through a respective one of the plurality of brackets.

4. The apparatus according to claim 3, further comprising a fastener for selectively fixing a respective one of the plurality of brackets relative to the frame.

5. The apparatus according to claim 3, wherein each of the plurality of brackets is formed with a slot for receiving a portion of a respective one of said plurality of lifting elements.

6. The apparatus according to claim 5, wherein the lifting elements are constituted by chains including a plurality of links, with a selected one of the links being adapted to be positioned in the slot of a respective one of the plurality of brackets in order to adjust a length of the chain relative to the supporting surface.

7. An apparatus for raising a buried article comprising:

a plurality of support leg assemblies, each of said support leg assemblies having a first end adapted to be placed upon a supporting surface, and a second end;

a frame shiftably mounted on said support leg assemblies wherein the frame can be lifted and lowered relative to the supporting surface, said frame including upper and lower crossbar sections having terminal ends, and a plurality of guide tubes, each of said plurality of tubes being attached to a respective one of the terminal ends of said upper and lower crossbar sections, wherein each of said support leg assemblies includes a threaded rod extending through a respective one of the guide tubes; and a plurality of lifting elements, each of said lifting elements having a first portion adapted to be connected, at a selected position along a length of a respective said lilting element, to said frame, and a second portion adapted to be removably attached to a buried article, wherein a buried article interconnected to the frame through the plurality of lifting elements cm be raised upon shifting of the frame relative to the plurality of support leg assemblies.

8. The apparatus according to claim 7, wherein each of said support leg assemblies further includes a foot support attached the threaded rod.

9. The apparatus according to claim 8, wherein the foot support is pivotally attached to the threaded rod.

10. A method of raising a buried article comprising:

locating a frame on a supporting surface above a buried article to be raised;

interconnecting lifting elements between the frame and the article to be raised;

adjusting the height of the frame relative to the supporting surface such that the article is raised to a position substantially flush with the supporting surface; and back-filling beneath the article to maintain the article substantially flush with the supporting surface.

11. The method according to claim 10, further comprising supporting the frame through a plurality of support leg assemblies each including a threaded rod.

12. The method according to claim 11, further comprising adjusting the height of the frame by manually rotating a collar engaged with the frame and threaded on the threaded rod.

13. The method according to claim 10, further comprising initially positioning tic frame so as to be substantially parallel to the supporting surface.

14. The method according to claim 10, further comprising shifting an attachment location of at least one of the lifting elements to the frame.

15. The method according to claim 14, further comprising fixing the attachment location.

16. The method according to claim 10, further comprising supporting the frame through a plurality of support leg assemblies each including a pivotable foot member engaging the supporting surface.

* * * * *